US006939150B1

(12) United States Patent
Lanni

(10) Patent No.: US 6,939,150 B1
(45) Date of Patent: Sep. 6, 2005

(54) FOLDABLE ELECTRICAL PLUG CONNECTOR

(75) Inventor: Thomas W. Lanni, Laguna Niguel, CA (US)

(73) Assignee: Comarco Wireless Technologies, Inc., Irvine, CA (US)

( * ) Notice: Subject to any disclaimer, the term of this patent is extended or adjusted under 35 U.S.C. 154(b) by 264 days.

(21) Appl. No.: 10/210,364

(22) Filed: Aug. 1, 2002

(51) Int. Cl.[7] ..... H01R 13/44; H01R 13/60
(52) U.S. Cl. ..... 439/131; 439/174
(58) Field of Search ..... 439/103–104, 439/106, 174, 131, 171, 640

(56) References Cited

U.S. PATENT DOCUMENTS

| | | | | |
|---|---|---|---|---|
| 1,386,884 A | | 8/1921 | McKay | |
| 3,027,507 A | | 3/1962 | Hubner | |
| 3,134,631 A | * | 5/1964 | Whalen | 439/104 |
| 3,958,849 A | * | 5/1976 | Blairsdale | 439/104 |
| 4,075,458 A | | 2/1978 | Moyer | 219/225 |
| 4,467,263 A | | 8/1984 | Conforti et al. | 320/2 |
| 4,626,052 A | | 12/1986 | Rumble | 339/31 |
| 4,697,070 A | | 9/1987 | Kai | 219/521 |
| 4,997,381 A | | 3/1991 | Oh | 439/172 |
| 5,401,178 A | * | 3/1995 | Liu | 439/131 |
| 5,494,449 A | | 2/1996 | Chioo et al. | 439/761 |
| 5,611,701 A | * | 3/1997 | Hahn | 439/131 |
| 5,613,863 A | * | 3/1997 | Klaus et al. | 439/131 |
| 5,628,641 A | * | 5/1997 | Hahn | 439/131 |
| 5,967,807 A | | 10/1999 | Wu | 439/131 |
| 6,089,886 A | | 7/2000 | Mareno | 439/131 |
| 6,126,460 A | | 10/2000 | Wu | 439/131 |
| 6,241,538 B1 | * | 6/2001 | Chen | 439/131 |
| 6,312,271 B1 | | 11/2001 | Tseng | 439/131 |
| D454,537 S | | 3/2002 | O'Connor et al. | D13/110 |
| 6,585,530 B2 | * | 7/2003 | Steiert et al. | 439/131 |
| 6,780,034 B2 | * | 8/2004 | Shiroshita et al. | 439/174 |

FOREIGN PATENT DOCUMENTS

| | | |
|---|---|---|
| GB | 2215531 | 9/1989 |
| GB | 2303256 | 12/1997 |

OTHER PUBLICATIONS

Press Release entitled "TeleAdapt's OEM division shows eye for innovation with its new UK folding plug," Mar. 22, 2001, retrieved from http://www.teleadaptusa.com/nma/press_ukfoldingplug.htm.

* cited by examiner

*Primary Examiner*—Hae Moon Hyeon
(74) *Attorney, Agent, or Firm*—Pillsbury Winthrop Shaw Pittman LLP

(57) ABSTRACT

Embodiments of the present invention are directed to an electrical plug connector including a plurality of prongs capable of being coupled to an electrical power source and an outer body having at least one recess. A gearing mechanism is configured to cause retraction of the plurality of prongs. The plurality of prongs is rotatably mounted to the gearing mechanism. At least a portion of each of the plurality of prongs is contained within the at least one recess when the plurality of prongs is retracted.

15 Claims, 3 Drawing Sheets

FOLDABLE ELECTRICAL PLUG CONNECTOR

BACKGROUND

1. Technical Field

Embodiments of the present invention generally relate to an electrical plug connector. More particularly, embodiments of the present invention relate to an electrical plug connector with retractable prongs.

2. Discussion of the Related Art

Electrical devices typically utilize an electrical plug connector in order to receive power from an electrical wall outlet or other power source. Electrical devices are often stored when not in use and/or during transfer from one place to another, and corresponding electrical plug connectors are generally stored with the electrical devices to enable use of the electrical devices upon reaching a destination. For example, many students and business persons carry personal computers in cases while traveling to and from classes or work. In another example, air travelers may pack electrical devices such as curling irons and electric shavers in their luggage. Because the prongs of an electrical plug connector protrude from its outer body, electrical plug connectors with fixed prongs are typically awkward in shape and may occupy a significant amount of space when stored in a confined area, such as a computer bag or a piece of carry-on luggage. Moreover, the prongs of an electrical plug connector generally have sharp edges that may pose a safety hazard.

To overcome these problems, several folding electrical plug connectors with retractable or removable prongs have been designed. One approach, disclosed in U.S. Pat. No. D454,537 ("the '537 Patent"), employs an interchangeable plug fitting that may be slidably detached from within a cavity formed in a main body. However, the interchangeable plug fitting may be misplaced after it is detached from the main body, especially if the interchangeable plug fitting is detached prior to transit. Furthermore, detaching the interchangeable plug fitting generally increases the storage space required to store the electrical plug connector.

According to another approach, disclosed generally in U.S. Pat. No. 6,312,271 ("the '271 Patent"), U.S. Pat. No. 5,401,178 ("the '178 Patent"), U.S. Pat. No. 6,089,886 ("the '886 Patent"), and U.S. Pat. No. 5,494,449 ("the '449 Patent"), a foldable electrical plug connector includes two retractable prongs. The two prongs are connected by a common rod about which the prongs are rotated from a first position, in which the prongs extend outward from a first face, to a second position in which the prongs fit into a groove within a connector housing. The prongs may be held in a retracted state by an orienting base (in the '271 Patent), a spring force (in the '178 Patent), notches (in the '886 Patent), or a tongue (in the '449 Patent).

U.S. Pat. No. 5,613,863 ("the '863 Patent"), U.S. Pat. No. 4,467,263 ("the '263 Patent"), U.S. Pat. No. 4,075,458 ("the '458 Patent"), and 3,027,507 ("the '507 Patent") disclose various electrical devices that utilize a retractable two-prong plug. However, none of these patents disclose a retractable plug suitable for use with three prong outlets of the type commonly used throughout Europe. Furthermore, these plugs do not provide the user with a simple way to change the foldable electrical plug connector from the retracted state to the extended state.

U.S. Pat. No. 6,126,460 ("the '460 Patent"), U.S. Pat. No. 5,967,807 ("the '807 Patent"), and U.S. Pat. No. 4,997,381

("the '381 Patent") describe a dual-use plug with two sets of two prongs. A primary plug may be retracted as a unit into a cavity in a power supply housing and the prongs of a secondary plug may be retracted into a cavity in the housing of the primary plug. Like the plugs disclosed in the '271 Patent and the '178 Patent, the prongs of the primary plug are joined by a casing that rotates with the prongs to place the primary plug in the retracted state. However, neither the '460 Patent, the '807 Patent, nor the '381 Patent discloses a system suitable for retracting and extending all three prongs in a three-prong electrical plug connector. Furthermore, these patents do not disclose a simple way for a user to extend the retracted prongs.

A TeleAdapt press release dated Mar. 22, 2001 discusses a folding plug product in which a three prong foldable electrical plug connector folds into its housing along an axis of rotation in the middle of the plug body. The three prongs are joined by a portion of the housing. However, this type of plug body appears to occupy more space than a typical electrical plug connector, rather than save space.

U.K. Patent Application No. 9514143.8 ("the '143 UK Application") and U.K. Patent Application No. 8901083.9 ("the '083 UK Application") each describe a three-prong foldable electrical plug connector, whose prongs are pivotally retracted into recesses in a body of the plug. In the connector described in the '143 UK Application, a ball-and-spring mechanism is used to maintain each prong in an extended position. The '143 UK Application shows all three prongs fold down in the same direction; whereas, in the '083 Application, a third prong folds in a direction opposite to the direction in which the first two prongs fold. However, neither the '143 UK Application nor the '083 UK Application discloses a mechanism, whereby the user may retract all of the prongs simultaneously or by a single force or action, making the process of extending or retracting the prongs needlessly cumbersome.

DETAILED DESCRIPTION

Reference in the specification to "one embodiment", "an embodiment", or "another embodiment" of the present invention means that a particular feature, structure or characteristic described in connection with the embodiment is included in at least one embodiment of the present invention. Thus, the appearances of the phrase "in one embodiment" or "according to an embodiment" appearing in various places throughout the specification are not necessarily all referring to the same embodiment. Likewise, appearances of the phrase "in another embodiment" or "according to another embodiment" appearing in various places throughout the specification are not necessarily referring to different embodiments.

A foldable electrical plug connector according to an embodiment of the present invention reduces the volume of space that is typically used to store a conventional electrical plug connector. Prongs of the foldable electrical plug connector may be retracted by applying a force to one of the prongs. Furthermore, when the foldable electrical plug connector is in a retracted state, one of the prongs may protrude beyond a body 140 of the foldable electrical plug connector to facilitate extension of the prongs.

Figure 1:
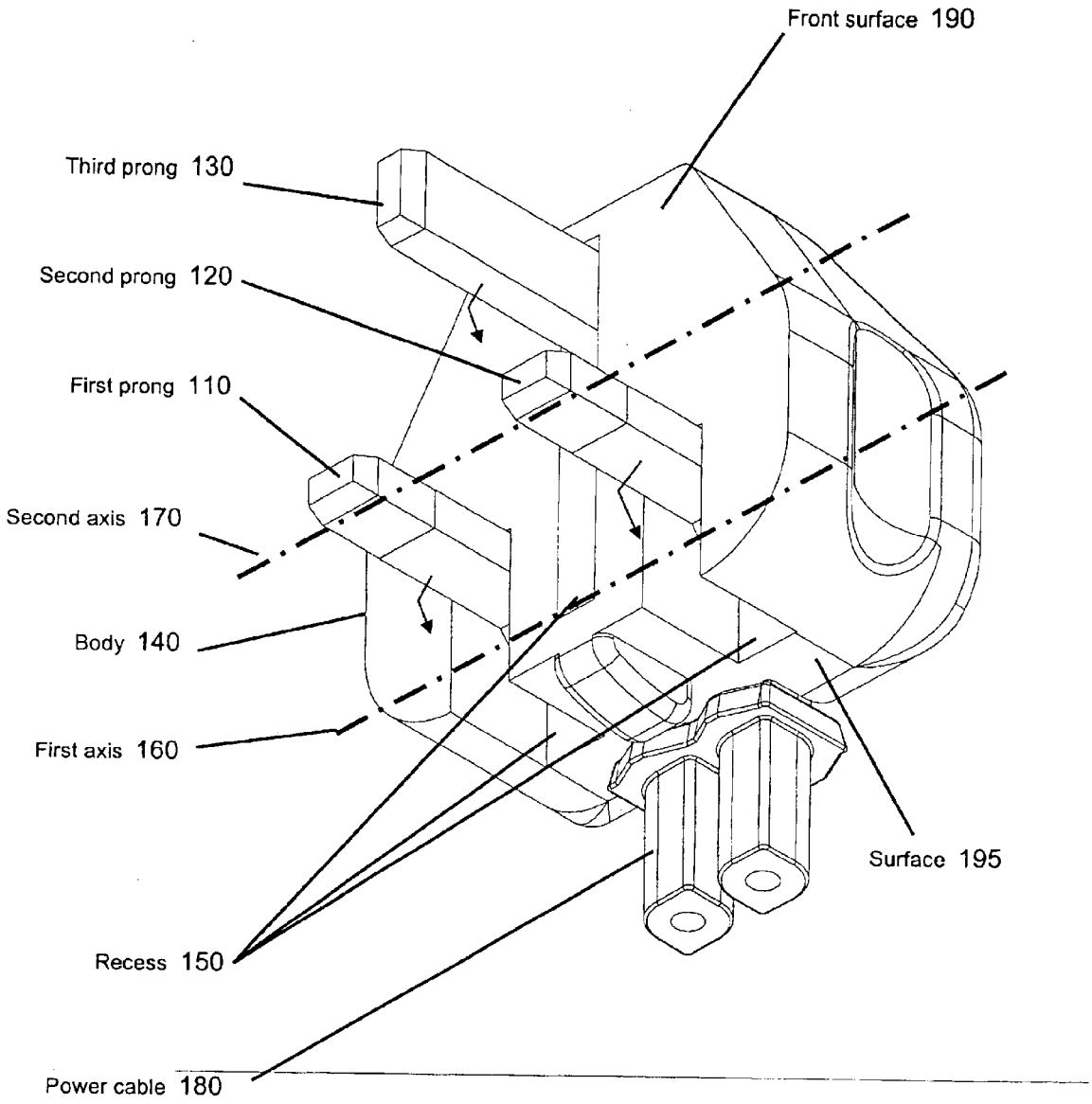
FIG. 1 illustrates a foldable electrical plug connector according to an embodiment of the present invention.
Figure 2:
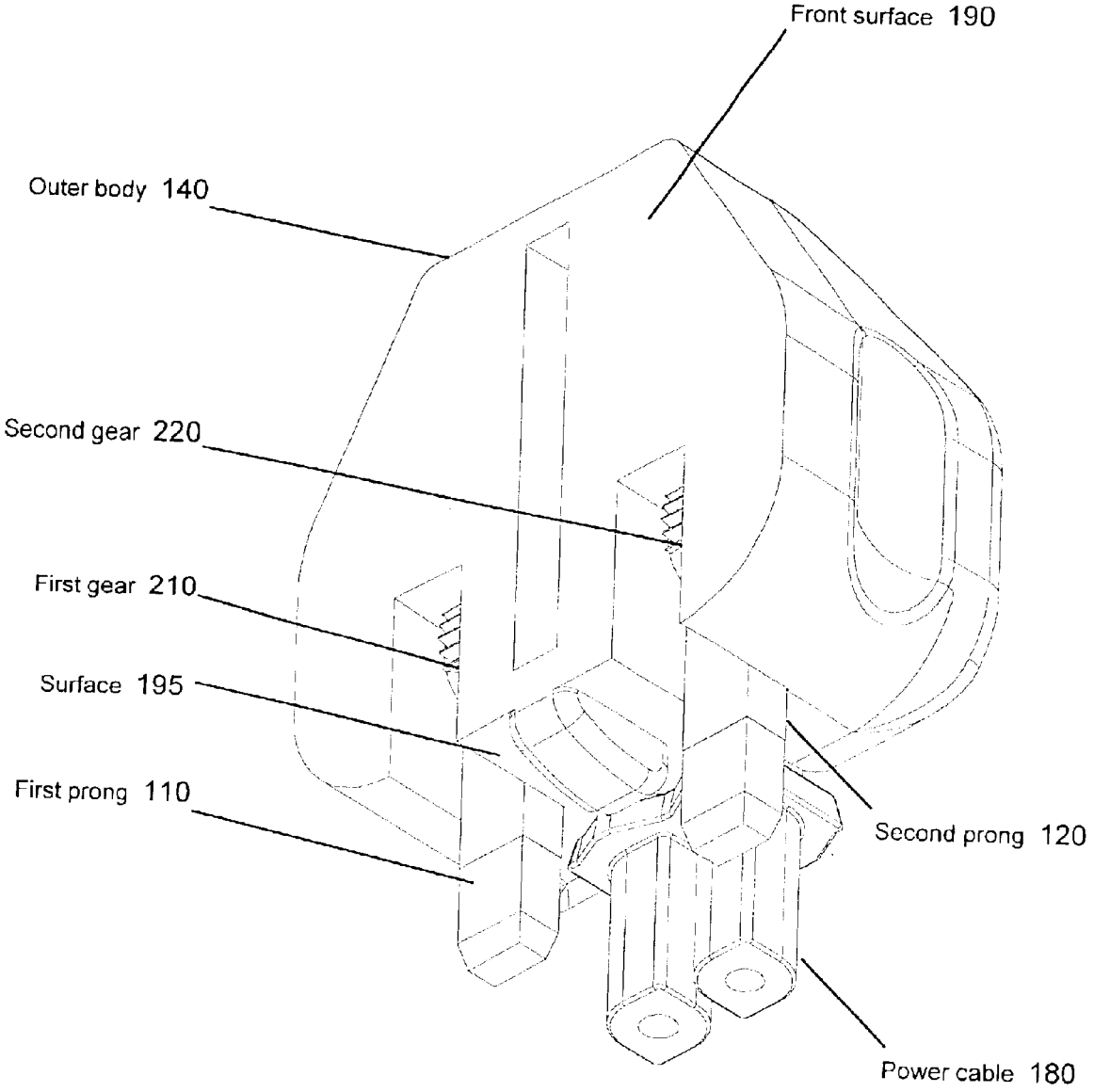
FIG. 2 illustrates a foldable electrical plug connector in a retracted state according to an embodiment of the present invention.

FIG. 1 and FIG. 2 illustrate a foldable electrical plug connector according to an embodiment of the present invention. FIG. 1 shows the foldable electrical plug connector in an extended state, while FIG. 2 illustrates the foldable electrical plug connector in a retracted state. The foldable electrical plug connector shown in both FIGS. 1 and 2 may include multiple prongs 110, 120, and 130, a body 140, a gearing mechanism (340 in FIG. 3), and a power cable 180 through which electrical power is transmitted to an electrical device. While only three prongs are shown, embodiments of the invention may have a greater or lesser number of prongs depending on the configuration of the power source to which the electrical plug connector is intended to be coupled. The prongs 110, 120, and 130 may be coupled to an electrical power source when in the extended state and may be decoupled from the power source before they are retracted. The prongs 110, 120, and 130 may be made of brass, copper, or a similar electrically conductive material, and may be plated with a material to prevent corrosion, such as nickel.

As shown in the illustrated embodiment of the present invention, the prongs may include a first prong 110, a second prong 120, and a third prong 130. The first prong 110 may be extended to couple to a positive terminal of the electrical power source, and the second prong 120 may be extended to couple to a negative terminal of the electrical power source. The third prong 130 may be configured to be coupled to a ground potential, such as a ground terminal of the electrical power source. In this way, electrical power may be received at the prongs 110, 120, and 130 and transmitted to an electrical device through a power cable 180. The prongs 110, 120, and 130 may be electrically coupled to conductive wires in the power cable 180.

The body 140 may be made of a non-conductive material and suitably light and rigid material, such as ABS plastic. The body 140 may have several outer surfaces, including a front surface 190 which may be in contact with or proximate to a face plate of an electrical outlet or a portion of some other power source when the prongs 110, 120, and 130 are inserted into the electrical outlet. It should be understood that the term "front surface" is meant only to denote that the prongs 110, 120 and 130 extend from surface 190 when extended and not to connote any relationship between front surface 190 and the remaining surfaces of the body 140 or to connote that the plug connector must be configured in a particular way during use.

The body 140 may have at least one recess 150 into which the prongs 110, 120, and 130 may be retracted, the retraction illustrated by the arrows of FIG. 1. As shown, the body 140 may have three recesses 150, each corresponding to one of the prongs 110, 120, and 130. The prongs 110, 120, and 130 may extend beyond the front surface 190 of the body 140 when the plug connector is in the extended state. The depth of the recesses 150 may be selected based on the dimensions of the prongs 110, 120 and 130 such that none or only portions of the prongs protrudes from a front surface 190 of the body 140 when the prongs 110, 120 and 130 are in the retracted state but a sufficiently large portion of the prongs extends beyond the front surface 190 in the extended state to couple to the desired power source.

According to the embodiment of the invention shown in FIG. 2, each of the prongs 110, 120, and 130 may retract in the same direction. The power cable 180 may be coupled to a surface 195 of the body 140. In an embodiment, at least one of the prongs 110, 120, and 130 may lie proximate the power cable 180 when the foldable electrical plug connector 100 is in a retracted state. In an embodiment, the prongs 110, 120, and 130 may remain electrically coupled to the power cable 180 when the foldable electrical plug connector 100 is in the retracted state. Alternatively, the prongs 110, 120, and 130 may be decoupled from the power cable 180 when the foldable electrical plug connector 100 is in the retracted state. For example, the prongs 110, 120, and 130 may disconnect from an electrical contact in the body 140 when the prongs 110, 120, and 130 pivot.

In the extended state, the prongs 110, 120, and 130 may extend perpendicular to the surface 190 of the body 140. In the retracted state, the prongs 110, 120, and 130 may be parallel to the power cable 180. The power cable 180 is generally flexible. Therefore, it is understood that "parallel to the power cable 180" means parallel with a portion of the power cable 180 near the point at which the power cable 180 is coupled to the body 140 of the foldable electrical plug connector 100.

According to an embodiment of the invention, at least one of the prongs 110, 120, and 130 may be entirely within the at least one recess 150 when the foldable electrical plug connector 100 is in the retracted state. For example, prong 130 is illustrated as being completely contained within its corresponding recess 150. Moreover, at least one of the prongs 110, 120 and 130 may extend beyond a surface 195 of the body 140 when the plug connector is in the retracted state (as is the case for prongs 110 and 120). This design facilitates extension of the prongs 110, 120, and 130. For example, a user may apply a force upon a portion of a prong that extends beyond the surface 195 of the body 140, such that the prong is rotated about an axis that extends through a base of the prong. In alternative embodiments of the invention, one or more of the prongs may extend beyond a different surface of the body 140, including, for example, the front surface 190. In embodiments of the invention in which portions of one or more of the prongs 110, 120 and 130 extend beyond a surface of the body 140, the exposed portions may include a gripping feature, such as a notch, to aid a user in applying force to the prong 110, 120 or 130.

Figure 3:
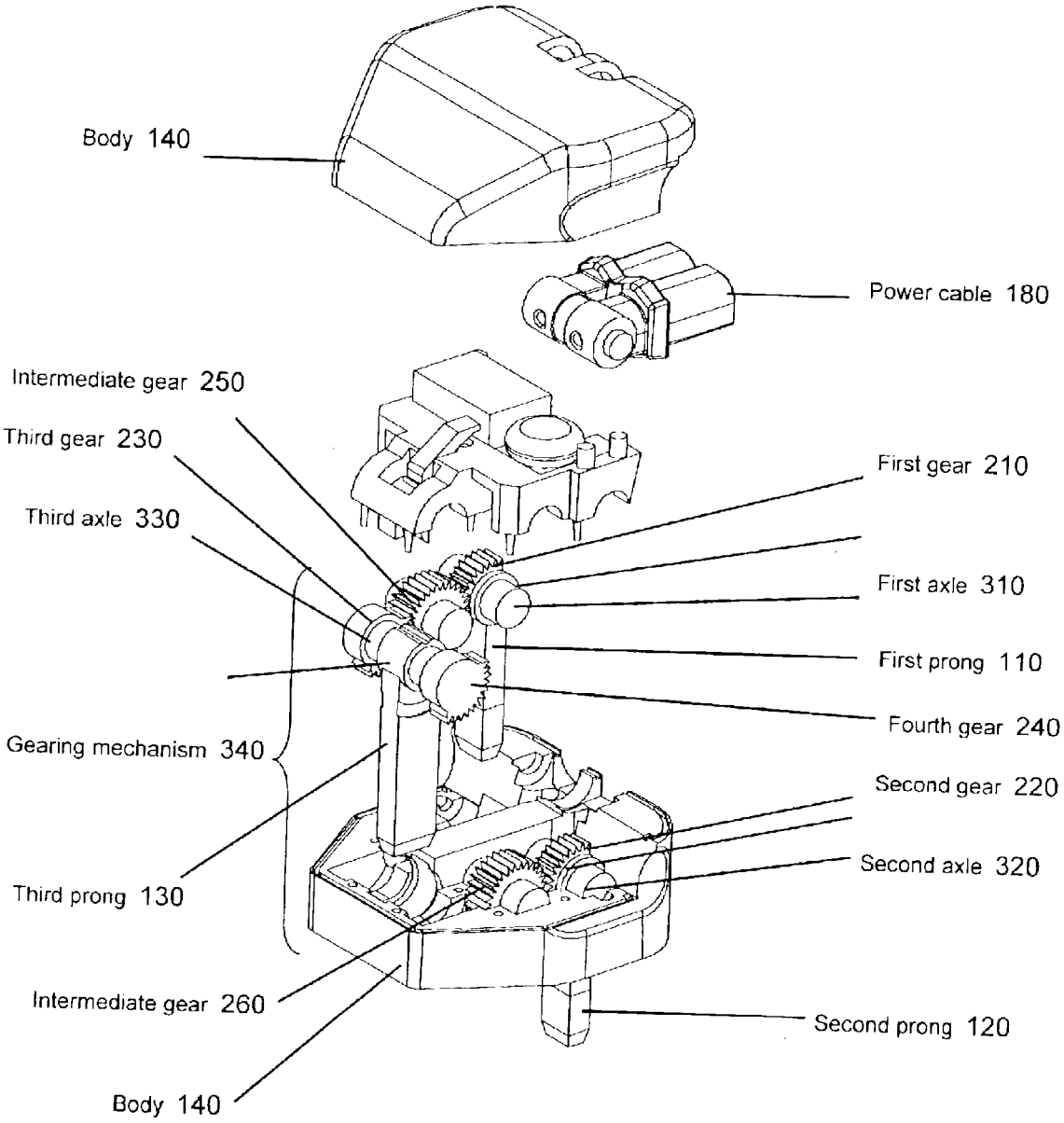
FIG. 3 illustrates an exploded view of a foldable electrical plug connector according to an embodiment of the present invention.

As shown in FIGS. 1–3, the third prong 130 may not be aligned with both the first prong 110 and the second prong 120. The first prong 110 and the second prong 120 may rotate about a first axis 160, and the third prong 130 may rotate about a second axis 170. The first axis 160 may extend through a base of the first prong 110 and a base of the second prong 120, and the second axis 170 may extend through a base of the third prong 130. The first axis 160 and the second axis 170 may lie parallel to each other. In an embodiment, the third prong 130 may retract in a first direction opposite to a second direction in which the first prong 110 and the second prong 120 retract. In alternative embodiments of the invention, the prongs 110, 120 and 130 may be retracted in other than a pivoting motion, e.g., by sliding the prongs 110, 120 and 130 into the recesses 150.

FIG. 3 illustrates an exploded view of a foldable electrical plug connector according to an embodiment of the present invention. In the illustrated embodiment, the gearing mechanism 340 may include a plurality of axles 310, 320 and 330. Each of the plurality of axles 310, 320 and 330 may be coupled to at least one of multiple gears 210, 220, 230 and 240 and at least one of the prongs 110, 120, and 130. The gears 210, 220, 230 and 240 may be coupled to the axles 310, 320 and 330 at different locations on the axles 310, 320 and 330. For example, first axle 310 is shown as coupled to first gear 210 and second axle 320 is shown as coupled to second gear 220 at locations proximate the center points of the first and second axles 310 and 320. Alternatively, third axle 330 is shown as coupled to third gear 230 and fourth gear 240 proximate the endpoints of the third axle 330. In an embodiment, the gears 210, 220, 230 and 240 may be coupled directly to the axles 310, 320, and 330 (as illustrated by third axle 330 and third and fourth gears 230 and 240). In another embodiment, the gears 210, 220, 230 and 240 may be coupled to collar portions 350, which may in turn be coupled to the axles 310, 320, 330 (as illustrated by first and second axles 310 and 320 and first and second gears 210 and 220). In an embodiment, the gears 205 may rotate in the plane of motion of the prongs 110, 120, and 130.

An axle 310, 320 or 330 may be coupled to one of the prongs 110, 120, and 130 by adhesive, solder, compression fitting, or any other suitable joining means. The axle 310, 320 or 330 may pass through an opening in the prong 110, 120, or 130. In particular embodiments, each of the prongs 110, 120 and 130 may have a collar portion 350 configured to fit around the axle 310, 320 or 330.

The gearing mechanism 340 may be configured to cause simultaneous retraction and/or extension of the prongs 110, 120, and 130. The simultaneous retraction and/or extension may occur when a force is applied to one of the prongs 110, 120, and 130. The prongs 110, 120, and 130 may be rotatably mounted to the gearing mechanism 340. When a force is applied to rotate one of the prongs 110, 120 and 130 about its corresponding axle 310, 320 or 330, the resulting torque may also be transmitted to the other axles 310, 320 and/or 330 via the gears 210, 220, 230 and 240 coupled to the axles and the intermediate gears 250 and 260. Thus, the gears 210, 220, 230, 240, 250 and 260 may be intermeshed. The transmitted torque may cause the remaining prongs to retract in concert with the prong 110, 120, or 130 to which the force was applied. It will be understood that, although FIG. 3 depicts some of the gears 210, 220, 230, 240, 250 and 260 as having teeth around only a portion thereof, the gears 210, 220, 230, 240, 250 and 260 may have a complete set of teeth around the entire circumference of each gear 210, 220, 230, 240, 250 and 260.

According to the illustrated embodiment, the gearing mechanism 340 may be configured such that the first prong 110 and the second prong 120 retract in a direction opposite that of the third prong 130. Intermediate gears 350 and 360 may be included in embodiments in such embodiments. Alternatively, in embodiments of the invention, the gearing mechanism 340 may not include intermediate gears 350 and 360. This may be the case, for example, in embodiments of the invention in which the prongs 110, 120 and 130 do not all retract in the same direction.

The plurality of axles 310, 320 and 330 and/or gears 210, 220, 230, 240, 250 and 260 may be composed of any suitable material. In embodiments of the invention, some or all of the axles 310, 320 and 330 and/or gears 210, 220, 230, 240, 250 and 260 may be electrically conductive. Alternatively, some or all of the plurality of axles 310, 320 and 330 and/or gears 210, 220, 230, 240, 250 and 260 may be electrically non-conductive. If an axle is electrically conductive, then a gear that is coupled to the axle is generally electrically non-conductive to avoid shorting two prongs together.

While the description above refers to particular embodiments of the present invention, it will be understood that many modifications may be made without departing from the spirit thereof. The accompanying claims are intended to cover such modifications as would fall within the true scope and spirit of an embodiment of the present invention. The presently disclosed embodiments are therefore to be considered in all respects as illustrative and not restrictive, the scope of an embodiment of the invention being indicated by the appended claims, rather than the foregoing description, and all changes that come within the meaning and range of equivalency of the claims are therefore intended to be embraced therein.

What is claimed is:

1. An electrical plug connector, comprising:

a power cable;

a first prong capable of being extended to connect to a first terminal of an electrical power source, the first prong being coupled to a first axle and the first axle being coupled to a first gear;

a second prong capable of being extended to connect to a second terminal of the electrical power source, the second prong being coupled to a second axle and the second axle being coupled to a second gear;

a third prong capable of being extended to connect to a third terminal of the electrical power source, the third prong being coupled to a third axle, the third axle being coupled to a third gear and a fourth gear, the first gear being coupled to the third gear and the second gear being coupled to the fourth gear, so that when one of the first prong, the second prong, or the third prong is retracted, the coupling of the third gear to the first gear, and the fourth gear to the second gear cause others of the first prong, the second prong, and the third prong to be retracted; and an outer body having at least one recess.

2. The electrical plug connector according to claim 1, wherein at least one prong of the first prong, the second prong, and the third prong protrudes beyond a surface of the outer body of the electrical plug connector when the first prong, the second prong, and the third prong are retracted.

3. The electrical plug connector according to claim 1, wherein the first prong, the second prong, and the third prong remain electrically coupled to the power cable when the first prong, the second prong, and the third prong are retracted.

4. The electrical plug connector according to claim 1, wherein the first prong, the second prong, and the third prong are decoupled from the power cable when the first prong, the second prong, and the third prong are retracted.

5. The electrical plug connector of claim 1, wherein at least one of the first prong, the second prong, and the third prong lie within the at least one recess when retracted, and at least one of the first prong, the second prong, and the third prong lie proximate the power cable when retracted.

6. The electrical plug connector of claim 1, further including a first intermediate gear to connect the first gear to the third gear and to allow the first prong to move with the third prong.

7. The electrical plug connector of claim 1, further including a second intermediate gear to connect the second gear to the fourth gear and to allow the second prong to move with the third prong.

8. The electrical plug connector of claim 1, wherein the first axle is coupled to the first gear proximate a center point of the first axle and the second axle is coupled to the second gear at a center point of the second axle.

9. An electrical plug connector, comprising:

a power cable;

a first prong capable of being extended to connect to a first terminal of an electrical power source, the first prong being coupled to a first axle and the first axle being coupled to a first gear;

a second prong capable of being extended to connect to a second terminal of the electrical power source the second prong being coupled to a second axle and the second axle being coupled to a second gear;

a third prong capable of being extended to connect to a third terminal of the electrical power source, the third prong being coupled to a third axle, the third axle being coupled to a third gear and a fourth gear, the first gear being coupled to the third gear and the second gear being coupled to the fourth gear, so that when one of the first prong, the second prong, or the third prong is retracted, the coupling of the third gear to the first gear, and the fourth gear to the second gear cause others of the first prong, the second prong, and the third prong to be retracted; and an outer body having at least one recess, wherein the first prong, the second prong, and the third prong rotate in a same angular direction when one of the first prong, the second prong, or the third prong is retracted.

10. The electrical plug connector of claim 9, wherein at least one prong of the first prong, the second prong, and the third prong protrudes beyond a surface of the outer body of the electrical plug connector when the first prong, the second prong, and the third prong are retracted.

11. The electrical plug connector of claim 9, wherein the first prong, the second prong, and the third prong remain electrically coupled to the power cable when the first prong, the second prong, and the third prong are retracted.

12. The electrical plug connector according to claim 9, wherein the first prong, the second prong, and the third prong are decoupled from the power cable when the first prong, the second prong, and the third prong are retracted.

13. The electrical plug connector according to claim 9, wherein at least one of the first prong, the second prong, and the third prong lie within the at least one recess when retracted, and at least one of the first prong, the second prong, and the third prong lie proximate the power cable when retracted.

14. The electrical plug connector of claim 9, further including a first intermediate gear to connect the first gear to the third gear and to allow the first prong to move with the third prong and a second intermediate gear to connect the second gear to the fourth gear and to allow the second prong to move with the third prong.

15. The electrical plug connector of claim 9, wherein the first axle is coupled to the first gear proximate a center point of the first axle and the second axle is coupled to the second gear proximate a center point of the second axle.

* * * * *